United States Patent [19]

Regan

[11] 3,999,234

[45] Dec. 28, 1976

[54] BODY SUPPORT

[76] Inventor: John J. Regan, 2316 N. Harlem Ave., Elmwood Park, Ill. 60635

[22] Filed: May 27, 1975

[21] Appl. No.: 581,140

[52] U.S. Cl. ..... 5/351; 5/353; 5/DIG. 2

[51] Int. Cl.[2] ..... A61G 07/02; A47C 27/22

[58] Field of Search ..... 5/348, 345, 355, 351, 5/353

[56] References Cited

UNITED STATES PATENTS

| | | | |
|---|---|---|---|
| 3,081,129 | 3/1963 | Ridder | 297/452 |
| 3,082,438 | 3/1963 | Nachman | 5/353 |
| 3,252,170 | 5/1966 | Frye | 5/351 |
| 3,828,378 | 8/1974 | Flam | 5/345 R |

*Primary Examiner*—Casmir A. Nunberg
*Attorney, Agent, or Firm*—Wegner, Stellman, McCord, Wiles & Wood

[57] ABSTRACT

A bed for supporting a user's body in a level condition thereon to minimize bodily irritations includes a base with a mattress cover over a plurality of movable body support elements carried by the base. The body support elements are vertically disposed and movably received in a pair of vertically spaced and horizontally disposed planar sheets which are carried by the base. Means resiliently mounting each body support element resists the depression of the elements and the elements which are beneath the heaviest parts of a user's body provide a greater support than the other elements.

13 Claims, 7 Drawing Figures

BODY SUPPORT

CROSS-REFERENCE

This application is an improvement of my copending application Ser. No. 344,594 filed Mar. 26, 1973, entitled "Multi-layered Contoured Mattress".

BACKGROUND OF THE INVENTION

This invention relates to a bed for supporting a reclining body thereon in a level condition.

There have been many theoretical analyses of the sleeping condition. As referred to in the Mar. 11, 1975, issue of *Enquirer*, entitled "Dreams Warn of Dangerous Illness and Can Save Your Life", human dreams often result from a stimulation of the mind by sensory impulses received during sleep. These impulses originate from movement of the body, pressure on the body from an unlevel condition, or internal bodily disturbances. Thus, sensory impulses which stimulate dreams have for the most part been associated with a bodily feeling of irritation that might go unnoticed because the irritation is not very strong. This theory can even be reduced to a particular part of the body as being the source of the irritation stimulating the dream.

As a result, the motor responses and the character of the dreams produced in human sleep can be traced to sensory impulses produced by physical discomforts incurred during sleep.

Therefore, the desirability of a body support which eliminates the physical discomforts incurred during sleep and increases the beneficial results from sleep has long been recognized. Representative prior art includes U.S. Pat. Nos. Schenker 2,469,084 and Shecter et al 3,047,888.

Schenker attempted to overcome the above physical discomforts and increase the beneficial results from sleep by adding a rigid metal plate shaped in accordance with an individual's anatomical configuration to a body support, as shown in FIGS. 1–8. However, the anatomical configuration of the rigid plate fails to support one lying on the body support in a level condition. The rigid plate does not provide the necessary maximum support in the areas of greatest weight by the body members on the mattress to overcome the sensory impulses associated with bodily irritations from an unlevel condition of the body during sleep.

Moreover, still other multi-layered mattresses provide maximum support to the wrong parts of the body, increasing bodily irritations and user's discomfort. An example of this wrong type of support is illustrated in FIG. 3 of Schecter et al., which shows a "hammocking" condition of the body.

SUMMARY OF THE INVENTION

It is a principal object of this invention to provide a new and improved bed which supports the body reclining thereon in a level condition to minimize bodily irritations during sleep by providing maximum support in the areas of greatest weight by the body members on the bed.

A further object of the present invention is to provide a new and improved body support which avoids the "hammocking" condition of the body reclining thereon.

In accordance with the present invention, a bed includes a base comprised of generally rectangular lower and upper frame sections. A pair of vertically spaced-apart planar sheets, one of which is secured between the lower and upper frame sections, and the other of which is mounted on top of the upper frame section, are carried by the base. Both of the horizontally disposed planar sheets have a plurality of holes extending vertically therethrough which are arranged in generally parallel rows. Each row has a plurality of holes. The parallel rows of holes on each planar sheet are in vertical alignment with one another. A plurality of body support elements of equal length are vertically disposed and movably received in the holes of the planar sheets for vertical movement. Each element has a portion which extends above the top planar sheets. These portions of the elements define a generally planar supporting surface for a user's body. The elements also have heads which are affixed to the upper ends of the elements. Coil springs surround each element. The upper and lower ends of the springs respectively engage the underside of the heads and the upper surface of the top planar sheet. The coils of the springs compress to conform the portions of the elements to a contour which supports the user's body in a level condition. The elements in the rows beneath the areas of the user's body, which exert the most pressure thereon, provide more support than the elements in other rows.

One feature of the invention is the placement of a tight fitting mattress cover which has elastic anchor straps on its periphery, over the body supporting elements by attaching the anchor straps to a plurality of spaced-apart hooks mounted on the outer surface of the end and side boards of the upper frame. The mattress cover prevents the dislodgment of the elements from their movable settings in the vertically aligned holes of the spaced-apart planar sheets when the pressure from the user's body is removed, releasing the elements from their depressed position as the coil springs urge the elements upwardly to their original position.

A further feature of the invention is that the rows and elements in those rows beneath the areas of the user's body which exert the most pressure on the mattress cover are spaced closer together. These elements include heads of a smaller dimension than the heads on the elements in other rows to effect the closer spacing and in order to increase the number of elements in these areas. This spacing of elements proportionally increases the amount of supportable weight in these areas to achieve the level condition of the user's body on the bed.

Still another feature of the present invention is that the rows and elements in those rows may be spaced equal distances apart over the entire length of the bed with heads on each element of similar dimensions. However, the spring strength associated with each element in the rows beneath the areas of the greatest weight or depression by the user's body on the bed is greater than the spring strength in other rows to provide a maximum support in these areas.

In accordance with another feature of the invention, the body supporting elements are comprised of a plunger with a solid post anchored to the bottom of the base with a coil spring affixed to the top for spring-biasing a plunger top telescopically received in a reciprocating relationship over the upper end of the solid post. The reciprocating plunger top further includes a bumper lip around the circumference of its bottom end to prevent total passage of the plunger top through the hole in the lower planar sheet. The plungers may be spaced closer together or include stronger springs in the rows beneath the areas of greatest weight by a user's body, as previously mentioned.

Yet another feature of the present invention is the provision of shim means which include holes corresponding to several rows of holes on the planar sheets. The shim means is placed transversely across the top planar sheet on the bed beneath areas of greatest weight by a user's body in order to change the height of the elements above the top planar sheet. This provides an easy method of applying additional support to level the user's body anywhere along its entire length on the bed.

According to another embodiment of the invention, the aforementioned elements are movably received in a plurality of generally rectangular members of two different sizes which are positioned transversely across the top planar sheet and at least one row of elements to raise the planar supporting surface beneath the shoulders and buttocks of one lying on the bed to effect the level condition of the body thereon.

Further features and advantages of the invention will readily be apparent from the following specification and from the drawings.

DESCRIPTION OF THE PREFERRED EMBODIMENT

Figures 1, 2, 3:
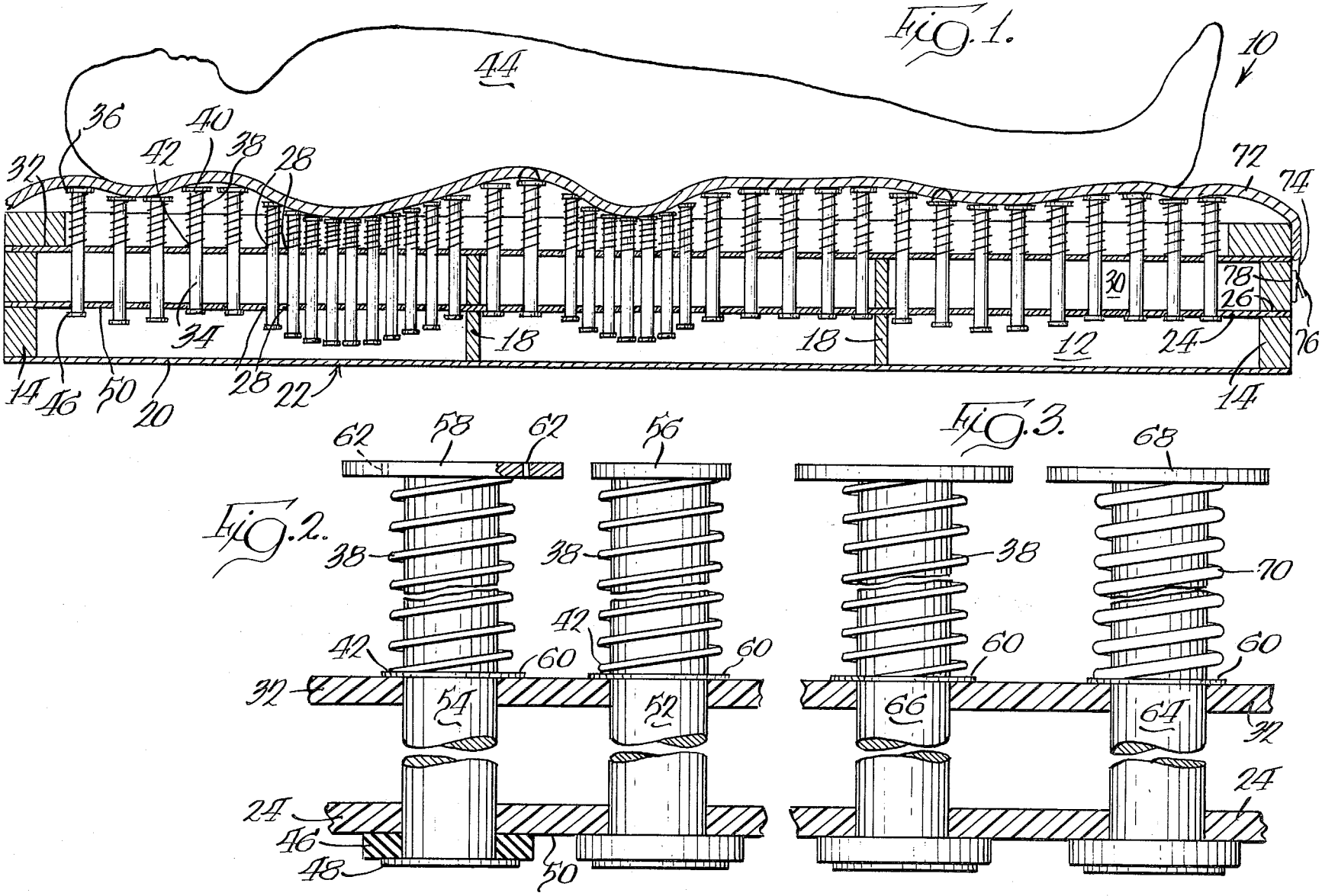
FIG. 1 is a side elevation of a bed made according to the invention with members shown in section.
FIG. 2 is a fragmentary, partially enlarged sectional side elevation of the body-supporting elements thereof.
FIG. 3 is a fragmentary, partially enlarged sectional, side elevation according to another form of the body-supporting elements thereof.

One embodiment of a bed for supporting a user's body reclining thereon in a level condition is illustrated in FIG. 1 and includes a base, generally indicated at 10. The base is comprised of a lower rectangular frame section 12 consisting of a pair of end boards 14 and a pair of side boards 16 and joists 18 which are all constructed of wood or any other suitable material. A pressed board 20 is secured to the bottom 22 of frame section 12 by a suitable means. A rectangular planar sheet 24 of acrylic material, which has approximately the same outer dimensions as that of the lower frame section 12 is placed on the generally planar top surface 26 of the lower frame 12. Sheet 24 includes holes located above the wooden members of the lower frame section 12 for receiving screws or the like to fasten the acrylic sheet 24 to the lower frame section 12. The sheet 24 also includes a plurality of holes 28 extending vertically therethrough which are arranged in generally parallel rows. Each row has a plurality of these holes.

The base 10 further includes an upper rectangular frame section 30 of substantially similar construction and dimensions as the lower frame section 12. The upper frame section 30 is stacked on top of the acrylic planar sheet 24 and secured to the lower frame section 12 by conventional fasteners or the like. A second acrylic planar sheet 32 of similar dimensions as sheet 24 is mounted in a similar fashion as sheet 24 to the top surface of the upper frame section 30. Planar sheets 32 includes the same parallel rows of holes 28 as planar sheet 24 and is positioned on top of frame section 30 so that the holes on each planar sheet are in vertical alignment with one another.

A plurality of body support elements 34, rods or posts of equal lengths, are vertically disposed and movably received in the vertically aligned holes 28 of the vertically spaced-apart planar sheets 24 and 32. Each rod has a portion that extends above the upper surface of sheet 32 to define a generally planar supporting surface for a reclining body. The rods 34 also include flat circular heads 36 affixed to the upper ends of the rods which define the generally planar supporting surface for the body.

Springs 38 of equal resilience have coils which surround the portions of the rods extending above the top surface of sheet 32. The upper and lower ends 40 and 42 of the springs 38 engage the underside of the flat heads 36 and the upper surface of the top sheet 32, respectively. The coils of the springs 38 compress to conform the rods 34 to a contour which straightens the user's body thereon by providing maximum support in the areas of greatest weight by the user's body on the rods. As shown in FIG. 1, the rows and the rods in those rows beneath the shoulders and the buttocks of a human body 44 reclining thereon are spaced closer together for providing maximum support to these areas of greatest weight on the bed. The resulting level condition of the user's body on the bed reduces the bodily irritations and increases the comfort experienced by the user in slumber. Moreover, the springs 38 urge the rods 34 upwardly to their original predepressed positions when pressure from the user's body is removed from them. The upward movement of the rods is limited by a soft rubber washer 46 and a stop disc 48 carried near the bottom and lower end of each rod, respectively, which are both located beneath the planar sheet 24. The rubber washer serves to cushion the abrupt halt of the upward movement of the rods 34 when the washer 46 and the stop disc 48, glued to the bottom of each rod, come into contact with one another against the underside 50 of the lower sheet 24 as shown in FIGS. 1, 2 and 3.

Turning now to FIG. 2, a body support element 52 in a row of body support elements beneath an area of greatest weight by the user's body on the bed is shown next to a body support element 54 in an adjacent row which is not beneath an area of greatest weight. In comparing the two elements, both elements have springs 38 with the same resilience. However, element 52 has a flat circular head 56 of approximately 1¼ inches in diameter, while element 54 has a flat circular head 58 of approximately 2 inches in diameter with a ¼ inch spacing between the heads on elements 52 and 54 which are approximately 1 inch in diameter. This results in a center-to-center distance between elements 52 and 54 of approximately 1⅞ inches. Therefore, an element with the head of 1¼ inches in a row to the right of element 52 would have a center-to-center distance therebetween of 1½ inches with the same spacing elements in those rows. An element in a row to the left of element 54 would have a center-to-center distance therebetween of 2¼ inches with the same spacing between elements in those rows. This means that the elements which are beneath the parts of user's body that exert the most pressure on the bed are spaced closer together to provide maximum support in these areas of greatest weight by the user's body on the bed. Moreover, the lower ends 42 of the coil springs 38 mounted on each element rest on a plastic washer 60 on the top surface of sheet 32 to dampen the slapping noise from the spring. As further shown in FIG. 2, element 54 has holes 62 through the flat circular head 58 for stitching it to a mattress cover or the like.

FIG. 3 shows a pair of body support elements 64 and 66 in the same location and of identical dimensions to those elements shown in FIG. 2, except that element 64 has a flat circular head 68 of 2 inches in diameter instead of the 1¼ inches diameter head of element 52. Therefore, the center-to-center distance between each row and the elements in those rows is 2¼ inches. However, element 64 on the right-hand side beneath the area of greatest weight by the user's body thereon has a stronger spring 70 which can support more weight than the coil spring 38 on element 66 on the left-hand side. As shown in FIG. 2, elements 64 or 66 may have thread holes through their flat circular heads. Selected elements in other rows may also have thread holes through their flat circular heads.

Figures 4, 5:
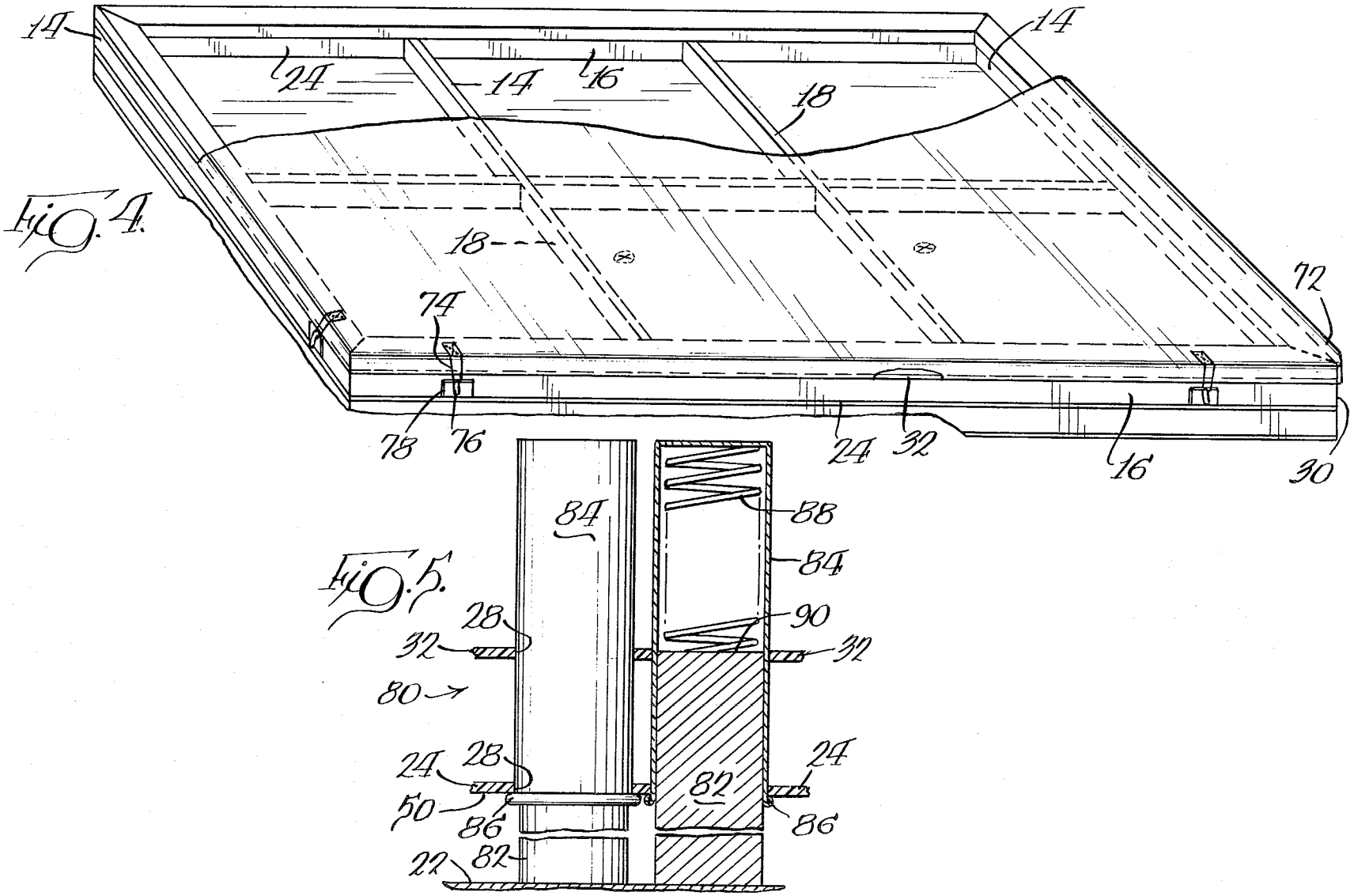
FIG. 4 is a partially sectional, plan view thereof.
FIG. 5 is a side elevation, partially sectioned according to still another form of the body-supporting elements thereof.

FIGS. 1 and 4 show a mattress cover 72 with elastic anchor straps 74 attached to the periphery of the mattress cover. A plurality of hooks 76 on base plates 78 are fastened by screws or the like to end and side boards 14 and 16, respectively, of the upper frame section 30 so that the anchor straps 74 may fit over the hooks 76. The placement of the mattress cover 72 over the flat heads 36 on rods 34 limits the upward movement of the rods 34 to prevent the rods from becoming dislodged from their movable settings in the holes of the vertically spaced-apart planar sheets 24 and 32 when the pressure from the user's body is removed therefrom, which causes the coil springs 38 to urge the depressed rods upwardly to their original position. The mattress cover 72 also eliminates the need for the washer 46 and stop disc 48 on the bottom of each rod. In addition, the mattress cover is stitched to selected rods through holes 62 on their heads to dampen the tendency toward an oscillating movement of the rods in the vertically aligned holes when suddenly released from their depressed state.

Referring now to FIG. 5, another construction for the body-supporting elements is illustrated. A plunger, generally indicated at 80, consists of a solid post 82 anchored to the bottom 22 of the base 10 that extends upwardly through the vertically aligned holes 28 on the planar sheets 24 and 32 to a position flush with the top surface of the upper sheet 32. A spring-biased hollow plunger top 84 is telescopically received over the upper end of the solid post 82. The reciprocating movement of the spring-biased plunger top 84 is limited by a bumper lip 86 attached around the circumference of the bottom end of the plunger top which is positioned below the underside 50 of the lower cross plate 24. The bumper lip 86 prevents the total passage of the plunger 84 through the hole 28 in the lower cross plate 24. A coil spring 88 is affixed to the top 90 of the solid post 82 and extends upwardly therefrom within the hollow of the plunger top 84, urging the plunger top upwardly to its predepressed position.

Figure 6:
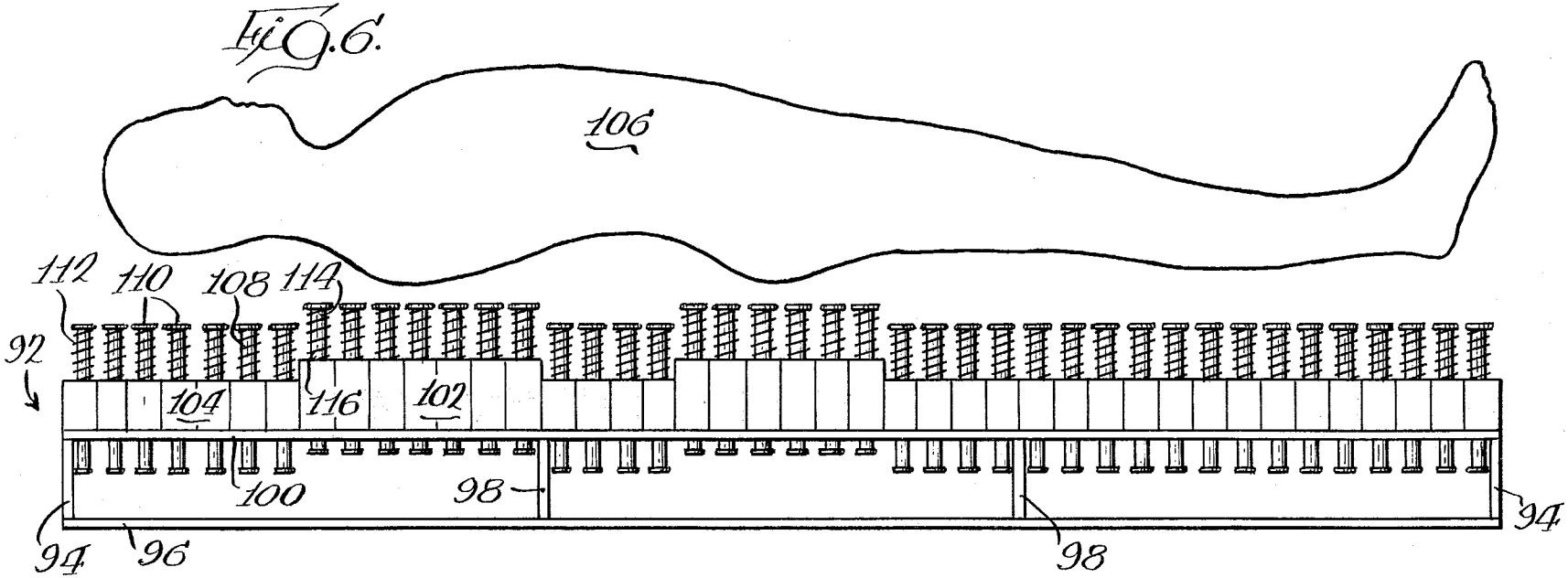
FIG. 6 is a side elevation of another embodiment of a bed made according to the invention, with members shown in section.

Referring now to FIG. 6, a second embodiment of the post-spring bed includes a base 92. The base 92 comprises a pair of end boards 94 and a pair of side boards (not shown) to form the frame. The frame has a press board 96 for its bottom with conventional joists 98 strengthening the frame structure. An acrylic planar sheet 100, similar in structure and with the same general arrangement of parallel rows of holes therethrough as previously mentioned for planar sheets 24 and 32, is secured to the top surface of the base 92 in a conventional manner. A plurality of generally rectangular members 102, 2×4's and 104, 2×3's, extend transversely across the top surface of the sheet 100. Each has at least one row of vertical holes therethrough in alignment with a row of holes on the sheet 100. The taller members 102 are beneath the shoulder and buttock area of a body 106 lying on the bed while members 104 extend transversely across the remaining surface area of the sheet 100. A plurality of elongated posts 108 with the same size heads 110 and coil springs 112 encircling the portion between the underside of the head and the top of the members 102 and 104 are vertically disposed and movably received in the vertically aligned holes in the members 102 and 104 and sheet 100.

Because the upper and lower ends 114 and 116 of the coil springs 112 respectively engage the underside of the heads 110 on the posts 108 and the upper surface of members 102 and 104, the posts 108 define a planar supporting surface which is raised up at the shoulder and buttock area of the body 44 on the bed. This provides increased support for the user's body in these two areas to obtain a level condition in slumber which minimizes bodily irritations resulting from unlevel conditions.

Figure 7:
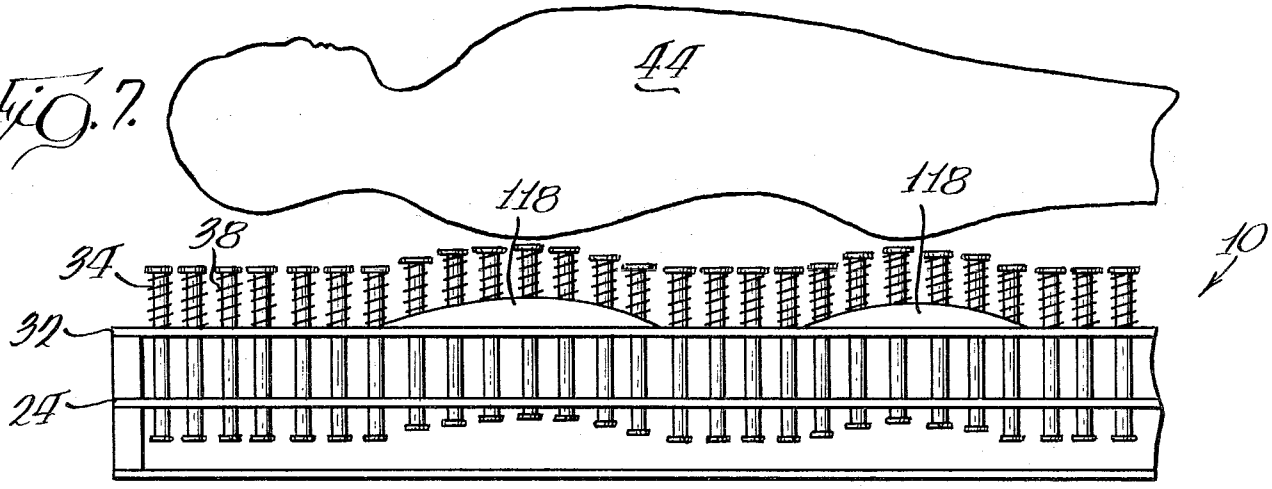
FIG. 7 is a fragmentary, partially sectioned, side elevation of shim means inserted across the bed of FIG. 1.

In another embodiment of the post-spring bed of FIG. 1, the rows and elongated posts 34 in those rows are equally spaced apart, and the coil springs 38 mounted on each post are equal in resilience. A shim means 118 or the like, as shown in FIG. 7, with several rows of holes therethrough which correspond to and align with the vertically aligned holes on planar sheets 24 and 32, is placed transversely across the top surface of the planar sheet 32 for movably receiving the posts. By inserting one or several of these shim means 118, panel members, between the coil springs mounting each of the posts and the upper surface of the top planar sheet 32, an easy method of customizing the bed to support a particular anatomical configuration is provided. Pressure may be selectively applied at any location on the post-spring bed to match the particular anatomical configuration of the user for providing maximum support in the areas of greatest weight by the user's body 44 on the bed. A selective increased counterpressure to the heavier part or parts of the body by raising the posts and springs in those areas with the insertion of the panel members 118 follows the general concept of the raised arrangement of the posts in FIG. 6 with one exception. The exception is that the upper surface of the panel member is curved generally in a physical inversion of the anatomical configuration of the user's body. Moreover, shims 118 simplify the post-spring bed construction because the requirement of spacing the elements closer together or increasing the spring strength mounted on the elements in the areas of greatest weight to provide extra support is no longer necessary. The pair of frame sections, one on top of the other, and the placement of the planar sheets, one between the frame sections and the other on top of the upper frame section, facilitate the assembly of this bed.

I claim:

1. A bed, comprising:

a generally horizontal frame;

a plurality of elongated body support elements movably carried by said frame for vertical movement with respect thereto, said elements being arranged in generally parallel rows with a plurality of elements in each row, each element having a portion extending above said frame, said portions of the elements defining a supporting surface for a user's body; and a spring between each support element and said frame resiliently mounting each of said support elements to yield from an initial position to a depressed position in response to pressure from the user's body thereon, said support elements in the areas beneath the parts of the user's body exerting the most pressure providing greater support than the support elements in the areas beneath other parts of the user's body for supporting the user's body lying on the bed in a generally level condition.

2. The bed of claim 1 wherein said rows and elements in those rows beneath the parts of the user's body exerting the most pressure thereon are spaced closer together than in the other rows for providing said greater support in the areas of greatest weight by the user's body on said elements.

3. The bed of claim 2 wherein said closer spaced elements are smaller in size than the elements in said other rows to effect the closer spacing, and said resilient means mounting each element has the same spring strength for all elements carried by said frame.

4. The bed of claim 1 wherein said elements are uniform in size, and said rows and elements in those rows are spaced equal distances apart, the strength of said resilient means for the elements being different in different rows to provide a maximum stiffness in the movement of the elements in the rows beneath the areas of greatest depression by the user's body on said elements.

5. The bed of claim 1 wherein said frame is rectangular in shape, said bed further including:

a pair of planar sheets carried by said rectangular frame, said sheets being generally horizontally disposed and vertically spaced apart, both of said sheets having a plurality of holes extending vertically therethrough in veritcal alignment with one another;

said body support elements comprise vertically disposed rods movably received in said aligned holes on the vertically spaced-apart planar sheets, each rod having a head at the top thereof; and said spring resiliently mounting each rod is a spring having a coil encircling the rod between the upper surface of the top planar sheet and the underside of the head which urges the body support elements upwardly for maintaining pressure of said elements against the user's body for supporting the same in said generally level condition.

6. The bed of claim 5 wherein the heads of selected rods have holes therethrough for stitching the same to a mattress cover or the like.

7. The post-spring bed of claim 1 wherein said frame is rectangular, and including:

a plurality of hooks mounted to the sides of said rectangular frame; and a mattress cover having elastic anchor straps on the periphery of said cover for securing the same over the upper ends of said rods by attaching the anchor straps to the hooks, said mattress cover restraining the rods when the pressure from a user's body is removed therefrom releasing the rods from a depressed position as the resilient mounting for each rod urges the same upwardly.

8. The bed of claim 5 wherein each rod includes means carried on its lower end which is engageable with the underside of said lower vertically spaced-apart planar sheet to limit the upward movement of said rods.

9. The bed of claim 1 wherein said body support elements comprise a vertically disposed solid post carried by said frame, a coil spring affixed to the top of said post, and a hollow plunger top telescopically received over the coil spring and the upper end of said post in reciprocating relation, said plunger top having stop means engageable with said frame for limiting the upward movement of the plunger top on said post.

10. A post-spring bed comprising:

a frame;

a plurality of elongated posts movably carried by said frame, each having a portion extending above said frame, said portions of the posts defining a generally planar supporting surface for a user's body, said posts being arranged in generally parallel rows with a plurality of posts in each row;

spring means between each of said posts and said frame, said posts yielding from an initial position to a depressed position in response to pressure from the user's body on said post; and a plurality of generally rectangular members of two different heights, each having holes therethrough and extending transversely across the top of said frame and each member having at least one row of holes corresponding to the position of a row of posts for movably receiving the same in said holes, said spring means being disposed on top of said members, the taller members being positioned beneath the shoulders and buttocks of one lying on the bed for raising said portions of the posts defining said generally planar supporting surface in those areas for supporting the body of one lying on the bed in a generally level condition.

11. A post-spring comprising:

a base;

a pair of planar sheets carried by said base, said sheets being generally horizontally disposed and vertically spaced apart, both of said sheets having a plurality of holes extending vertically therethrough arranged in generally parallel rows, there being a plurality of holes in each row, said parallel rows of holes in each sheet being in vertical alignment with one another;

a plurality of elongated posts movably received and vertically disposed in said aligned holes on the vertically spaced-apart planar sheets for vertical movement therein, each post having a portion extending above the top planar sheet, the portions of said posts defining a supporting surface for a user's body;

spring means mounted on each of said posts to yield from an initial position to a depressed position in response to pressure from the user's body thereon; and shim means having holes for movably receiving said posts and extending transversely across said bed between the spring means mounting each of said posts and the upper surface of said top planar sheet to establish the basic profile of said supporting surface beneath the areas of a user's body exerting the most pressure on said posts for supporting the body of one lying on the post-spring bed in a generally level condition.

12. A post-spring bed of claim 11 wherein said shim means are panel members defined by a flat underside and curved upper surface which is generally a physical inversion of the anatomical configuration of the user's body, each panel member having a plurality of rows of holes corresponding to the position of the vertically aligned rows of holes on said pair of planar sheets when the panel members are placed transversely across the top planar sheet.

13. The post-spring bed of claim 11 wherein said base has a generally rectangular configuration including a pair of frame sections, one on top of the other, each having a pair of end boards and a pair of side boards to form said frame sections, said pair of planar sheets being positioned, one between the upper and lower frame sections and the other on top of said upper frame section to facilitate the assembly of said bed.

* * * * *